US007375065B2

(12) United States Patent
Maxwell et al.

(10) Patent No.: US 7,375,065 B2
(45) Date of Patent: May 20, 2008

(54) METHOD AND COMPOSITION FOR CLEANING A FLUID DELIVERY SYSTEM

(75) Inventors: Jeffrey Maxwell, White Lake, MI (US); Stephen Summerfield, Macomb, MI (US)

(73) Assignee: Gage Products Company, Ferndale, MI (US)

( * ) Notice: Subject to any disclaimer, the term of this patent is extended or adjusted under 35 U.S.C. 154(b) by 148 days.

(21) Appl. No.: 11/019,020

(22) Filed: Dec. 21, 2004

(65) Prior Publication Data

US 2005/0137104 A1 Jun. 23, 2005

Related U.S. Application Data

(60) Provisional application No. 60/531,914, filed on Dec. 22, 2003.

(51) Int. Cl.
*C11D 3/37* (2006.01)
*C11D 3/44* (2006.01)
*C11D 9/24* (2006.01)
*B08B 3/04* (2006.01)

(52) U.S. Cl. ..... 510/170; 510/174; 510/183; 510/185; 510/188; 510/466; 510/475; 510/505; 510/506; 134/8; 134/22.11; 134/22.14; 134/22.19; 134/38; 134/39; 134/40; 134/42

(58) Field of Classification Search ..... 510/170, 510/174, 183, 185, 188, 466, 475, 505, 506; 134/8, 22.11, 22.14, 22.19, 38, 39, 40, 42
See application file for complete search history.

(56) References Cited

U.S. PATENT DOCUMENTS

| | | | | | |
|---|---|---|---|---|---|
| 4,172,803 | A | * | 10/1979 | Ichikawa et al. | 252/60 |
| 4,968,447 | A | * | 11/1990 | Dixon et al. | 510/202 |
| 5,423,919 | A | | 6/1995 | Dieter et al. | 134/8 |
| 5,536,439 | A | | 7/1996 | Harbin | 510/212 |
| 5,616,183 | A | | 4/1997 | Dieter et al. | 134/8 |
| 5,993,561 | A | | 11/1999 | Jarema | 134/7 |
| 5,993,562 | A | * | 11/1999 | Roelofs et al. | 134/7 |

* cited by examiner

*Primary Examiner*—Brian Mruk
(74) *Attorney, Agent, or Firm*—Gifford Krass Anderson Sprinkle & Citkowski

(57) ABSTRACT

A composition for cleaning a fluid delivery system includes an agent which controls the rheology of the fluid so that its apparent viscosity decreases as the fluid is subjected to a shear force. In particular applications, the viscosity of the composition is greater than 600 centipoise when it is not subject to any shear and less than 600 centipoise when subject to a shear of at least 10 1/sec. The fluid may be thixotropic or a Bingham plastic, in some instances. In a specific embodiment, the viscosity of the composition is greater than 3000 centipoise when it is not subject to shear, less than 3000 centipoise at a shear of 10 1/sec, less than 1000 centipoise at a shear of 30 1/sec, and less than 600 centipoise at a shear of 60 1/sec. Also disclosed are methods for cleaning a fluid delivery system with these compositions.

4 Claims, 1 Drawing Sheet

METHOD AND COMPOSITION FOR CLEANING A FLUID DELIVERY SYSTEM

RELATED APPLICATION

This application claims priority of U.S. Provisional Patent Application Ser. No. 60/531,914 filed Dec. 22, 2003 entitled "Method and Composition for Cleaning a Fluid Delivery System", which is incorporated herein by reference.

FIELD OF THE INVENTION

This invention relates generally to cleaning compositions and processes. More particularly, the invention relates to compositions and processes for cleaning fluid delivery systems such as paint delivery systems.

BACKGROUND OF THE INVENTION

Systems for the large scale painting of motor vehicles, vehicle components, fixtures, appliances, and other mass produced items of manufacture are relatively complex and include fluid lines, tanks, valves, and the like. Likewise other fluid handling systems such as food or chemical processing equipment include similar structures. The internal surfaces of such systems are often cleaned by pumping one or more cleaning fluids therethrough and in some instances, such cleaning fluids include a particulate material therein which aids in the cleaning process. In a typical cleaning process, a number of precleaners and/or rinse fluids are also passed through the system prior to and/or after the use of the particulate containing cleaning fluid.

In the context of cleaning a paint delivery system, various cleaning fluids of the type which are the subject of this present patent application function to solvate deposits and remove debris from a paint line system. These deposits and debris can include hardened paint residues as well as particulates resultant from contaminants in the paint, metal particles which are shed by valving, pipe joints, pumps and the like, traces of pigment and so forth. It is generally desirable that line cleaning compositions have a relatively low viscosity so that the agents can effectively flow through and penetrate all portions of the delivery system. In addition, it is generally desirable to avoid high viscosity fluids, since pumping, valving and other components of the system are not engineered for handling such high viscosity fluids.

While low viscosity cleaning compositions are desired, there are problems associated therewith, since low viscosity fluids are not very effective at suspending particulate materials. This is not a problem when the fluid is flowing relatively rapidly; but when the fluid flow slows as a result of passing through sumps or other drops in the system, or when flow is terminated, suspended particles can rapidly settle out of low viscosity fluids thereby negating the effects of the cleaning process. But, as noted above, use of high viscosity cleaning fluids is undesirable, and in some instances can actually damage pumps, valves and other components. Therefore, it will be appreciated that there is a need for a class of line cleaning compositions including precleaners, cleaners, purgents, rinses, scouring agents and the like which are capable of efficiently suspending particulate matter therein. Such fluids should also be compatible with the structure and operational requirements of paint delivery systems and associated cleaning equipment.

In many instances, the industry is now turning to the use of water-based paints and other process fluids. Hence, there is a need for paint line cleaning compositions which are compatible with water-based paints. Such compositions should be effective in removing residues of water-based paints and in purging lines of water-based paints. Such compositions must also be compatible with subsequently introduced water-based process fluids.

As will be explained hereinbelow, the present invention provides a system of line cleaning compositions which have very specifically controlled rheological properties. The compositions of the present invention have a very high resting viscosity, but thin to a low viscosity when a particular shear threshold is passed. In this manner, the fluids of the present invention are very efficient at suspending and retaining particulate matter; but, their viscosity thins in use to enable effective cleaning and prevent any mechanical burden or damage to associated equipment. These and other advantages of the invention will be discussed in detail hereinbelow.

SUMMARY OF THE INVENTION

Disclosed herein is a method for cleaning a fluid delivery system. The method employs a cleaning composition comprising a solvent and an agent for controlling the rheology of the composition so that the apparent viscosity of the composition decreases as the composition is subjected to a shear force. In particular embodiments of the invention, the viscosity of the cleaning composition is greater than 600 centipoise when it is not subject to any shear, and less than 600 centipoise when it is subject to a shear of at least 10 1/sec. In specific embodiments, the composition is thixotropic, while in other embodiments the composition is a Bingham plastic.

The composition may include a particulate material therein to aid in cleaning the system. In particular embodiments, the composition is used for cleaning systems handling water-based material, and the composition is water compatible, and any particulate material utilized therein may be water soluble.

Also disclosed herein are some specific cleaning compositions used in the practice of the method of the present invention, and methods for using the compositions.

DETAILED DESCRIPTION OF THE INVENTION

Figure 1:
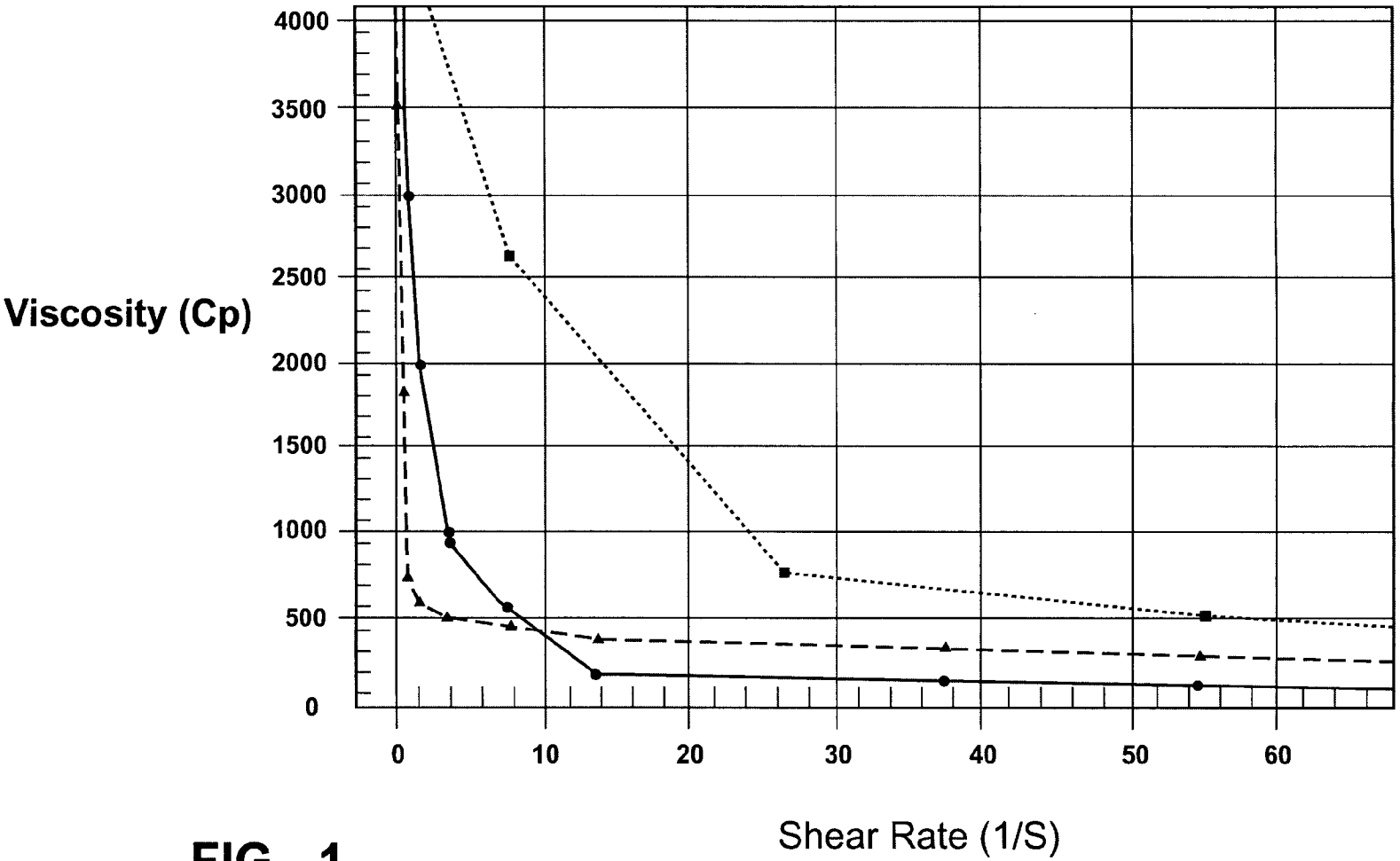
FIG. 1 is a graph showing the viscosity of certain compositions of the present invention as a function of shear.

The present invention is directed to compositions and methods for cleaning a fluid delivery system. Such fluid delivery systems include, but are not limited to, systems for delivering paint to automated painting systems of the type used in the manufacture of motor vehicles and other large articles of manufacture. The present invention may also be employed in connection with the cleaning of fluid delivery systems such as food handling systems, chemical processing systems, and any other such system which includes delivery lines, tanks, pumps, valving and the like. The fluids employed in the present invention include cleaning compositions which may or may not include a particulate material therein, as well as flushing compositions, rinsing compositions, purging compositions, conditioning compositions and the like.

The present invention is characterized in that the rheology of the fluids utilized in the invention is controlled so that the viscosity of those fluids decreases as they are subjected to a shear force above a certain threshold. In a typical process for cleaning a paint handling system, shear rates in the range of 100-1600 1/sec are typically encountered. In other pumping operations, other ranges of shear may be encountered. Use of fluids having controlled rheological properties confers a number of advantages not attainable by prior art methods and materials. The high rest viscosity of the compositions enables them to better retain particles in suspension therein. Such particles may comprise particles of an abrasive material included in the composition to enhance its cleaning activity, as well as particles of contaminants removed from a system in the course of cleaning. The ability to retain particles in suspension stabilizes the compositions during shipping and storage, and also prevents suspended particles from settling out in a fluid handling system when flow of the fluid is terminated or when the fluid passes through sumps, tanks or other such structures which cause a decrease in its flow velocity. The fact that the fluid will thin under shear causes its viscosity to decrease when it is being pumped through a system, and this drop in viscosity allows for a vigorous flow of fluid which aids in removing contaminants from the system. Also, the drop in viscosity will decrease burdens on pumps and other fluid handling structures.

In some instances, the rheological properties of the fluids of the present invention are such that the fluids are thixotropic, and as such exhibit shear thinning. In other instances the fluids are better characterized as being Bingham plastics. As is understood in the art, a Bingham plastic fluid exhibits a relatively high viscosity until such time as an applied shear force exceeds a yield threshold. Thereafter, viscosity of the fluid decreases sharply, and this decrease may further be in proportion to consequently applied shear levels. In yet other instances, the rheological properties of the fluids of the present invention may be a combination of thixotropic and Bingham plastic, or otherwise characterized, provided that those fluids exhibit shear thinning properties consistent with the requirements of present invention.

In specific embodiments, it has been found that the fluids utilized in the practice of the present invention will exhibit a viscosity of greater than 600 centipoise when those fluids are not subject to shear, and a viscosity of less than 600 centipoise when those fluids are subject to a shear which is at least 10 1/sec (inverse seconds) as such term is known and interpreted in the art. In one particular group of fluids used in the present invention, the viscosity of the compositions is greater than 2000 centipoise when not subject to any shear, less than 2000 centipoise at a shear of 5 1/sec, less than 1000 centipoise at a shear of 10 1/sec, and less than 600 centipoise at a shear of 15 1/sec. In particular instances, the fluids of the present invention retain a viscosity of at least 500 centipoise at a shear rate of 5 1/sec; but thin to a viscosity of less than 1000 centipoise at a shear rate of 10 1/sec. This combination of viscosity properties assures that particles will remain in suspension when fluids are in storage or otherwise not being pumped. The moderate viscosity retained under low shear (5 1/sec) assures that random vibrations, shocks, thermal effects, and the like, will not decrease viscosity unduly. Fluids having the above-described characteristics exhibit a very strong viscosity drop under shear conditions typically encountered in the use and cleaning of typical fluid handling systems.

There are a number of agents which may be used to control rheological properties of fluids. One of skill in the art will readily be able to select an appropriate type and amount of agent in view of the nature of the fluid and the guidelines provided herein. Viscosity control agents include an organic material such as amorphous silica, clays and other minerals. Viscosity control agents may also include semi-synthetic materials such as organically modified clays (organoclays) as is known in the art. Viscosity control agents may also comprise organic materials such as cellulose-based materials and synthetic organic molecules. One class of organic thickener comprises glycerol esters, and a specific example of glycerol ester thickeners is glyceryl tri 12-hydroxystearate.

The composition of the solvent component of the compositions of the present invention will depend upon the particular application in which the invention is implemented. In those instances where the invention is being used to clean fluid handling systems which process water-based materials such as water-based paints and the like, the solvent component should be aqueous-based or water compatible. As is understood in the art, water compatible materials are highly miscible with water, and typically comprise polar organic molecules such as alcohols, ethers, esters, lactones, lactams, and various combinations thereof. In some particular instances where water-based paints are being processed in a fluid handling system, the solvent may comprise a glycol ether such as a cellosolve. The compositions may also include one or more polar species such as amines, carboxylic acids and the like. In some instances, water compatible fluids may be aqueous based themselves and may comprise a mixture of water together with alcohols, detergents, surfactants and the like.

In other instances, the solvent system may not be water compatible, and may include aromatic and aliphatic hydrocarbon mixtures. Such non-aqueous solvent systems may also include surfactants as well as accelerator species such as amines and acids.

Compositions of the present invention may include a particulate abrasive material as noted above. The abrasive may, in some instances, comprise a polymeric material such as polypropylene. In other instances, the abrasive material may comprise an inorganic material. In particular instances, this may comprise an abrasive material such as silica, mica, alumina or the like, while in other instances, the particulate material may be a lower hardness material such as a carbonate or bicarbonate salt, talc, mineral oxides or the like. In some particular instances, it has been found advantageous to employ water-soluble particulate materials in the cleaning compositions. These materials are selected so as to be insoluble in the solvent mixture itself, and readily soluble in water or high-water-content mixtures. In this manner, a particulate containing material may be flowed through a system and subsequently purged by water or high-water-content materials which solvate and remove traces of particulate material. Such water soluble materials include carbonates and bicarbonates of sodium, potassium, and other alkali metals. Still other water soluble salts may be similarly employed. In other instances the particulate material may comprise calcium carbonate or some other mineral which dissolves in a weak acid.

In a typical cleaning operation, a series of fluids are pumped through a fluid handling system. The system is typically flushed with a precleaner composition to remove paint or other fluid therefrom. Thereafter, a cleaning composition, which may include particulate material therein, is pumped through the system for a period of time sufficient to remove deposits therefrom. The cleaning action of this composition may be enhanced by use of heat and/or by imparting a vibratory energy, such as ultrasonic energy, to the system. The cleaning composition is rinsed from the system with a rinse fluid, which may be the same fluid used for precleaning or a different fluid. Following the rinse, the system may be flushed with a further solvent mixture, water, or an organic fluid. This sequence of steps may be repeated or modified, as will be apparent to one of skill in the art. Following the cleaning process, the system is put back into service.

Within the guidelines presented hereinabove, the various compositions will be readily apparent to those of skill in the art. Some specific compositions are detailed hereinbelow on Table A, which lists ten compositions labeled A-J.

TABLE A

| | A | B | C | D | E | F | G | H | I | J |
|---|---|---|---|---|---|---|---|---|---|---|
| $C_9$–$C_{10}$ aromatic | | | | 75 | 76.3 | 45.7 | 45.3 | 50.3 | 24.8 | 41.25 |
| $C_{10}$–$C_{11}$ aromatic | | | | 3.1 | | | | | | |
| Butyl cellosolve | 81.3 | 81.2 | 79.2 | | | | | | | 41.25 |
| Glyceryl 12-hydroxy stearate | | 2.2 | 1.7 | | | | | | | |
| Dimethylethanolamine | 0.8 | 0.8 | 0.9 | 0.9 | | | | | | |
| Modified montmorillonite organoclay | | | | 2.9 | | | 1.8 | 3.4 | 3.5 | 4 |
| Calcium carbonate coated with stearic acid | | | | | 23.7 | | | | | |
| Glycerol | | | 3.1 | | | | | | | |
| Oleic acid | | | 2 | 4 | | | | | | |
| 85% Triethanolamine - Low Freeze Grade | | | 1.1 | 2.1 | | | | | | |
| Bentonite organoclay | | | | | | 4 | | | | |
| Amorphous silica | 3.2 | | | | | | | | | |
| Soda Ash | 14.7 | 15.8 | 12 | 12 | | | | 11.2 | | 11 |
| Isopropyl alcohol (99%) | | | | | | 25.2 | | | | |
| Glycolic acid (70%) | | | | | | 12.6 | | | | |
| Polypropylene particles | | | | | | | 9.2 | | 9.3 | |
| n-butyl acetate | | | | | | 12.5 | | 8.81 | | |
| m-pyrol | | | | | | | 1.6 | | | |
| Isobutyl isobutyrate | | | | | | | 19.1 | | | |
| Dibasic esters | | | | | | | 18.6 | | | |
| Diacetone alcohol | | | | | | | 4.4 | | | |
| Dodecyl benzene sulfonic acid | | | | | | | | 1.7 | | 1 |
| Monoethanolamine | | | | | | | | 1.7 | | 1.5 |
| Linear alcohol ethoxylate surfactant | | | | | | | | 10.9 | | |
| Xylene sulfonic acid (90% in methanol) | | | | | | | | 4.2 | | |
| R-toluene sulfonic acid/isopropanol | | | | | | | | 6.32 | | |
| 1-propanamine, 3(hexyloxy) branched | | | | | | | | 0.84 | | |
| Dicyclohexylamine nitrite | | | | | | | | 0.1 | | |
| N-methyl morpholine | | | | | | | | 0.4 | | |
| Alkyl betaine | | | | | | | | 0.13 | | |
| Methyl isobutyl ketone | | | | | | | | | 29 | |
| Potassium hydroxide 100% flake | | | | | | | | | 4.4 | |
| Propylene glycol methyether | | | | | | | | | 29 | |
| TOTAL | 100 | 100 | 100 | 100 | 100 | 100 | 100 | 100 | 100 | 100 |

Composition C of Table A is a formulation particularly adapted for cleaning paint delivery systems which handle water-based paint compositions. As such, composition C is water compatible and includes a water-soluble particulate material therein, namely sodium carbonate. The Theological properties of composition C are set forth in FIG. 1, by a curve defined by dotted data points. It will be noted that the initial viscosity of this material is over 2000 centipoise when it is at rest; however, the material rapidly thins under shear so that the viscosity is only about 200 centipoise when it is subjected to a shear rate of approximately 14 1/sec. Furthermore, the composition retains a viscosity of greater than 500 centipoise at a shear rate of 5 1/sec. In a typical cleaning operation, shear rates encountered in the pumping of a cleaning fluid are on the order of 100-1600 1/sec, and in specific instances, 200-300 1/sec. This combination of initial high viscosity and rapid, controlled, thin down is optimum for suspending particles in a fluid which is at rest or moving very slowly. Furthermore, the thin down of the viscosity facilitates both pumping and cleaning actions.

Also shown in FIG. 1 are the rheological properties of a second composition as indicated by the curve defined by triangular data points. This composition comprises on a weight basis 1% hydroxypropyl cellulose and 99% ethylene glycol butyl ether. This material can be used as a water compatible purge or rinse composition, and it could also include particulate material to enhance its cleaning action. As illustrated, this composition exhibits excellent shear thinning properties in accord with the present invention.

FIG. 1 also illustrates the rheological properties of a third composition, by a curve defined by square data points. This composition corresponds to formula E in Table 1. In the formula E composition, the viscosity of the composition decreases at a somewhat slower rate as compared to the other two compositions. The illustrated curves represent a range of formulations in accord with the present invention and specific rheological profiles may be selected in accord with particular applications for the formulations.

In general, formulations of the present invention will have a viscosity of at least 3000 centipoise at rest, a viscosity of less than 3000 centipoise at a shear rate of 10 1/sec; a viscosity of less than 1000 centipoises at a shear rate of 30 1/sec; and a viscosity of less than 600 at a shear rate of 60 1/sec. In certain applications, a quick thin down is desired and such compositions will have a viscosity of less than 1000 centipoise (and in specific instances, less than 600 centipoise) at 10 1/sec.

In use, the compositions of the present invention are pumped through a fluid delivery system. The combination of particulate material, solvent, and thixotropic nature of the material provides for a very good cleaning action which removes residues of both water-based and solvent-based paints. In a typical process for cleaning paint lines which have carried water-based paints, the system is first drained and purged of paint by blowing the lines down with compressed air. In some instances, lines may be rinsed with water, or a precleaning agent, prior to the blow down. Following this treatment, a composition of the present invention is flowed through the system. Typically, the composition is recirculated through the system for a period of time sufficient to clean the system. In a typical situation, the composition flows through the system at a relatively slow rate of 1-3 feet per second. Following the cleaning, the composition of the present invention is drained from the system. The draining may optionally be accompanied by a blow down step. Following the draining of the composition, the system is typically rinsed with a rinse composition which may comprise water or a water-based fluid. In those instances where the composition includes a water soluble particulate material, rinsing with a water containing composition will dissolve any particular residue remaining in the system. Following the rinse step, the system may then be recharged with paint; although, in some instances, a further rinse step may be implemented.

It is to be understood that the foregoing is illustrative of particular embodiments of the invention, and particular applications thereof, and is not meant to be a limitation upon the practice thereof. In view of the teaching presented herein, yet other variations of the composition and method of the present invention will be apparent to one of skill in the art. It is the following claims, including all equivalents, which define the scope of the invention.

The invention claimed is:

1. A composition for cleaning lines of a fluid delivery system, said composition comprising by weight:

80-98% of a liquid vehicle including xylene, isobutyl butyrate and a methyl ester of a $C_3$-$C_6$ dibasic acid;

2-20% of a polymeric material dispersed in the vehicle, said polymeric material being selected from the group consisting of polypropylene, polyvinylchloride, polyethylene, polytetrafluoroethylene, copolymers thereof, and mixtures thereof; and a rheology control agent operative to control the rheology of the composition so that the apparent viscosity of the composition decreases as the composition is subjected to a shear force.

2. The composition of claim 1, wherein the viscosity of said composition is greater than 3000 centipoise when it is not subjected to shear, less than 3000 centipoise at a shear of 10 1/sec, less than 1000 centipoise at a shear of 30 1/sec, and less than 600 centipoise at a shear of 60 1/sec.

3. The composition of claim 1, wherein said vehicle includes a $C_9$-$C_{10}$ aromatic solvent, m-pyrol, isobutyl isobutyrate, methyl esters of adipic acid, methyl esters of succinic acid, methyl esters of glutamic acid, and diacetone alcohol; and wherein said rheology control agent comprises a clay-based material and said particulate material comprises polypropylene.

4. A water compatible composition for cleaning a fluid delivery system, said composition comprising, on a weight basis:

70-90% of 2-butoxyethanol;

0-5% of dimethylethanolamine;

1-5% of an agent for controlling the rheology of the composition so that the apparent viscosity of the composition decreases as the composition is subjected to a shear force; and 2-20% of a solid particulate material which is dispersed in said composition.

* * * * *